US006035792A

United States Patent [19]

Yoshida

[11] Patent Number: 6,035,792

[45] Date of Patent: Mar. 14, 2000

[54] SEWING MACHINE

[75] Inventor: Masaki Yoshida, Komaki, Japan

[73] Assignee: Brother Kogyo Kabushiki Kaisha, Nagoya, Japan

[21] Appl. No.: 09/337,488

[22] Filed: Jun. 21, 1999

[30] Foreign Application Priority Data

Jun. 25, 1998 [JP] Japan ..... 10-179030

[51] Int. Cl.[7] ..... D05C 9/04

[52] U.S. Cl. ..... 112/103; 112/319

[58] Field of Search ..... 112/103, 102.5, 112/470.06, 314, 319, 323

[56] References Cited

U.S. PATENT DOCUMENTS 5,231,941 8/1993 Wakayama ..... 112/103 X
5,824,104 2/1994 Hori et al. ..... 112/103 X
5,826,526 10/1998 Tomita ..... 112/102.5

FOREIGN PATENT DOCUMENTS 4-371189 12/1992 Japan .

*Primary Examiner*—Peter Nerbun
*Attorney, Agent, or Firm*—Oliff & Berridge, PLC

[57] ABSTRACT

A pressing portion is formed at one end portion of a horizontal wall portion of a cloth feeding unit, a bed portion is installed with a moving member pressed by the pressing portion and a slide member pressed to move by the moving member, a pivoting lever is pivoted by moving the slide member, a switch lever is switched to a drop position by the pivoting lever and a follower of the switch lever is switched to a position in correspondence with an escape driving cam. At such a time, a contact portion of the moving member is exposed to outside of a machine cover and can be visually observed and an operating portion of the slide member can be observed visually by being exposed to the outside via a notched window.

11 Claims, 16 Drawing Sheets

SEWING MACHINE

BACKGROUND OF THE INVENTION

1. Field of the Invention

The invention relates to a sewing machine attachably and detachably mounted with an embroidery cloth feeding unit for sewing embroideries in synchronism with the upward and downward movement of a needle bar by operating a feed dog drop mechanism of the sewing machine.

2. Description of the Related Art

Conventionally, there has been reduced to practice an embroidery cloth feeding unit (referred to also as an embroidering machine) attachably and detachably mounted to and from a sewing machine bed portion such that embroideries can be sewn by an ordinary electronic control type sewing machine for household use. According to an electronic control type sewing machine of this kind, in sewing a practical seam, because the work-cloth mounted on a needle plate of the sewing machine bed portion is fed by a feed dog, the feed dog projects from an upper face of the needle plate and is thereafter lowered to a lower side of the needle plate by a so-called four feed motion. In sewing an embroidery pattern, feeding of the work-cloth is executed by moving an embroidery frame by a cloth feeding unit mounted to the bed portion and, accordingly, the feed dog is maintained in a drop state in which the feed dog is always dropped to escape to a drop position on the lower side of the needle plate by a feed dog drop mechanism.

For example, according to the "sewing machine" disclosed in JP-A-4-371189 proposed by the applicant, there is installed a cam member integrally fixed with a vertically driving cam and a cam for dropping positioned at a lower shaft thereof, there is installed a feed dog drop mechanism for switching the position of the cam member from a vertically moving position to an escape position in accordance with a pivoted position of a pivotable operating projection, the feed dog is always driven forwardly and downwardly by a horizontally driving mechanism and, in sewing a practical seam, the work-cloth is fed by the feed dog moving upwardly and downwardly by swinging a vertically driving lever which is brought into contact with the vertically driving cam. Meanwhile, in sewing an embroidery pattern mounted to a sewing machine by pushing a cloth feeding unit along a free lower arm portion, the vertically driving lever is made to correspond to the cam for dropping by the feed dog drop mechanism and the feed dog is switched to the drop position on the lower side of the needle plate.

For that purpose, the cloth feeding unit is formed with a notched opening, an upper portion of which is opened for containing a front end portion of a bed portion when the cloth feeding unit is mounted to the bed portion of the sewing machine, and is installed with a pushing piece projected upwardly in the opening from a horizontal wall portion functioning as a bottom wall of the notched opening. When the cloth feeding unit is mounted to the bed portion, the free lower arm portion of the bed portion is fitted to connect to the notched opening. At the same time, the operating projection in the bed portion is pivoted by the pushing piece by which the cam member is switched via the feed dog drop mechanism and the horizontally driving lever is made to correspond to the cam for dropping to thereby maintain the feed dog at the drop position.

In this case, according to the technology disclosed in JP-A-4-371189, when the cloth feeding unit is mounted to the bed portion, even in the case in which the cloth feeding unit can firmly be mounted to the bed portion by pushing the cloth feeding unit to a predetermined mounting position, the pushing piece on the side of the cloth feeding unit is concealed in the unit, the feed dog drop mechanism and the operating projection for operating the drop mechanism on the side of the sewing machine are also concealed in the bed portion. Accordingly, particularly for a beginner, whether the feed dog drop mechanism is operated to be able to sew embroideries cannot be confirmed by visual observation, thereby causing apprehension in the beginner.

Even in the case in which the feed dog drop mechanism is not switched to operate in a state of an operational failure in mounting, where the cloth feeding unit is not sufficiently pushed to a predetermined mounting position, the failure cannot be confirmed. Accordingly, when the beginner attempts to sew embroideries by incorrectly believing that embroideries can be sewn, in addition to movement of cloth by the embroidery frame, there is also the incorrect operation of feeding the work-cloth by the feed dog. Further, there is also the problem that, because the pushing piece in a projected shape is installed at the horizontal wall portion of the cloth feeding unit, dirt is caught by the pushing piece and accumulates there.

SUMMARY OF THE INVENTION

It is an object of the invention to be able to confirm the state of mounting of an embroidery cloth feeding unit to a sewing machine simply by visual observation and to prevent dirt from adhering due to a failure to install the projected portion in the cloth feeding unit.

In order to achieve the object, according to an aspect of the invention, there is provided a sewing machine having a free lower arm, the sewing machine comprising an embroidery cloth feeding unit attachably and detachably mounted to the free lower arm, a moving member installed at a lower portion of the free lower arm and moved by mounting the embroidery cloth feeding unit, and a vertically moving mechanism driven by movement of the moving member for upwardly and downwardly moving a feed dog of the sewing machine, wherein at least a portion of the moving member is exposed such that the portion can be visually observed from outside of the free lower arm.

Accordingly, when the embroidery cloth feeding unit is mounted to the free lower arm, the moving member is moved and at the same time, the vertically moving mechanism is driven to thereby lower the feed dog. At this time, a portion of the moving member can be visually observed by the operator. Accordingly, the operational state of the vertically moving mechanism can be recognized. Thereby, a failure to mount the cloth feeding unit to the free lower arm can be prevented.

Further, according to a preferable embodiment of the invention, the embroidery cloth feeding unit includes a horizontal wall portion slidably brought into contact with a lower portion of the free lower arm and a portion of the horizontal wall portion is brought into contact with the moving member for moving the moving member when the embroidery cloth feeding unit is mounted to the free lower arm.

Therefore, a portion of the horizontal wall portion is brought into contact with the moving member and, accordingly, there is no to need to separately install a projected member. Therefore, dirt and the like is not accumulated.

Further, according to a preferable embodiment of the invention, the moving member is provided at either of a front end portion and a rear end portion of the free lower arm. Therefore, the state of movement of the moving member can be directly observed from a front side or a rear side of the free lower arm.

Further, according to another aspect of the invention, there is provided a sewing machine having a switch manually switchable between a first position and a second position, a vertically moving mechanism for upwardly and downwardly moving a feed dog between an elevated position and a lowered position by switching the switch, an embroidery cloth feeding unit attachably and detachably mounted to the free lower arm and a moving member installed at a lower portion of the free lower arm and moved by mounting the embroidery cloth feeding unit in which the switch is switched to the second position by being pressed by movement of the moving member when the embroidery cloth feeding unit is mounted to the free lower arm. Therefore, when the cloth feeding unit is mounted to the free lower arm, the movement member is moved and, at the same time, the switch is switched to the second position. Therefore, the operational state of the vertically moving mechanism can easily be recognized.

Further, according to a preferable embodiment of the invention, the switch includes marks displaying whether the feed dog is disposed at the elevated position or disposed at the lowered position. Therefore, a user can move the feed dog upwardly and downwardly by operating the switch in correspondence with the mark. Further, the operational state of the vertically moving mechanism can be readily recognized.

BRIEF DESCRIPTION OF THE DRAWINGS

The invention will be described in greater detail with reference to preferred embodiments thereof and the accompanying drawings, wherein.

DESCRIPTION OF THE PREFERRED EMBODIMENTS

Next, an explanation will be given of preferred embodiments according to the invention with reference to the drawings.

According to the embodiments, the invention is applied to an electronically controlled sewing machine capable of sewing embroideries by mounting an embroidery cloth feeding unit.

Figure 1:
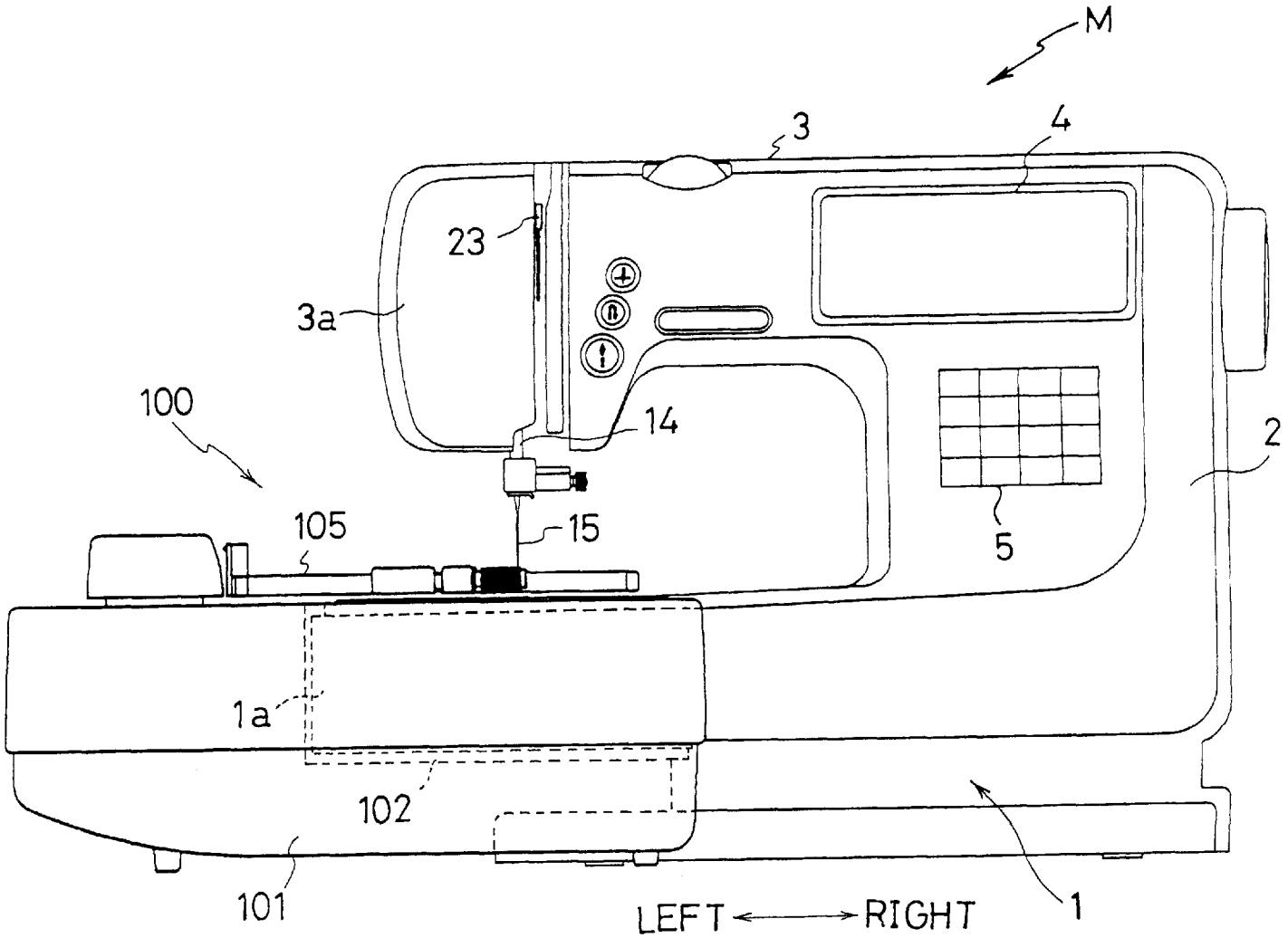
FIG. 1 is a front view of an electronically controlled sewing machine according to an embodiment of the invention.

As shown in FIG. 1, the electronically controlled sewing machine M is capable of sewing practical patterns (such as straight stitch and zigzag stitch) as well as embroideries by attachably and detachably mounting an embroidery cloth feeding unit 100 to and from the sewing machine M. The sewing machine M is provided with a bed portion 1, a pedestal portion 2 erected at a right end portion of the bed portion 1 and an arm portion 3 extended from an upper end of the pedestal portion 2 in the left direction (as viewed in FIG. 1 and as the sewing machine is normally viewed by the operator. All directions are relative to the operator facing the front, or display side, of the sewing machine) to extend over and oppose the bed portion 1.

Figure 4:
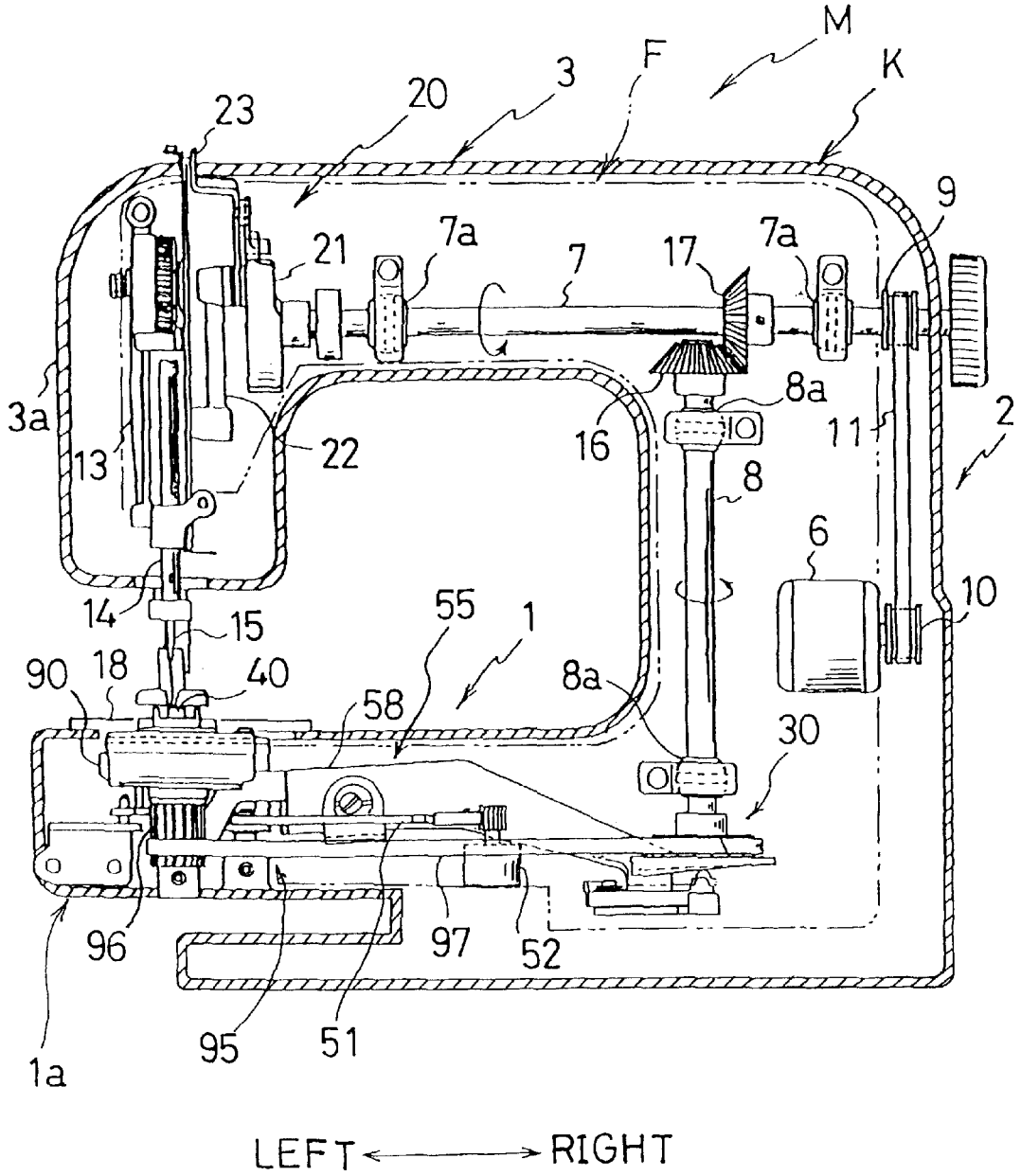
FIG. 4 is a front, partially sectional view showing the inner structure of the sewing machine.

A head portion 3*a* at a left end of the arm portion 3 has installed therein at least a sewing needle 15 and a needle thread take up 23. The bed portion 1 includes a feed dog 40 (FIG. 4) for feeding a work-cloth.

The arm portion 3 includes a display 4 and an operation panel 5. Various instructions are inputted to a control unit of the sewing machine M through the operation panel 5 and display 4 by which various patterns (a plurality of kinds of practical seams, various embroidery patterns) can be sewn. The bed portion 1 includes a free arm portion 1*a* to enable mounting of a cloth feeding unit 100. The free arm portion 1*a* extends in the left direction (FIG. 1) in an overhanging or extending shape and a main body case 101 of the cloth feeding unit 100 engages with the free arm portion 1*a* in an external fitting manner by which the cloth feeding unit 100 is attachably and detachably mounted to the bed portion.

Figure 3:
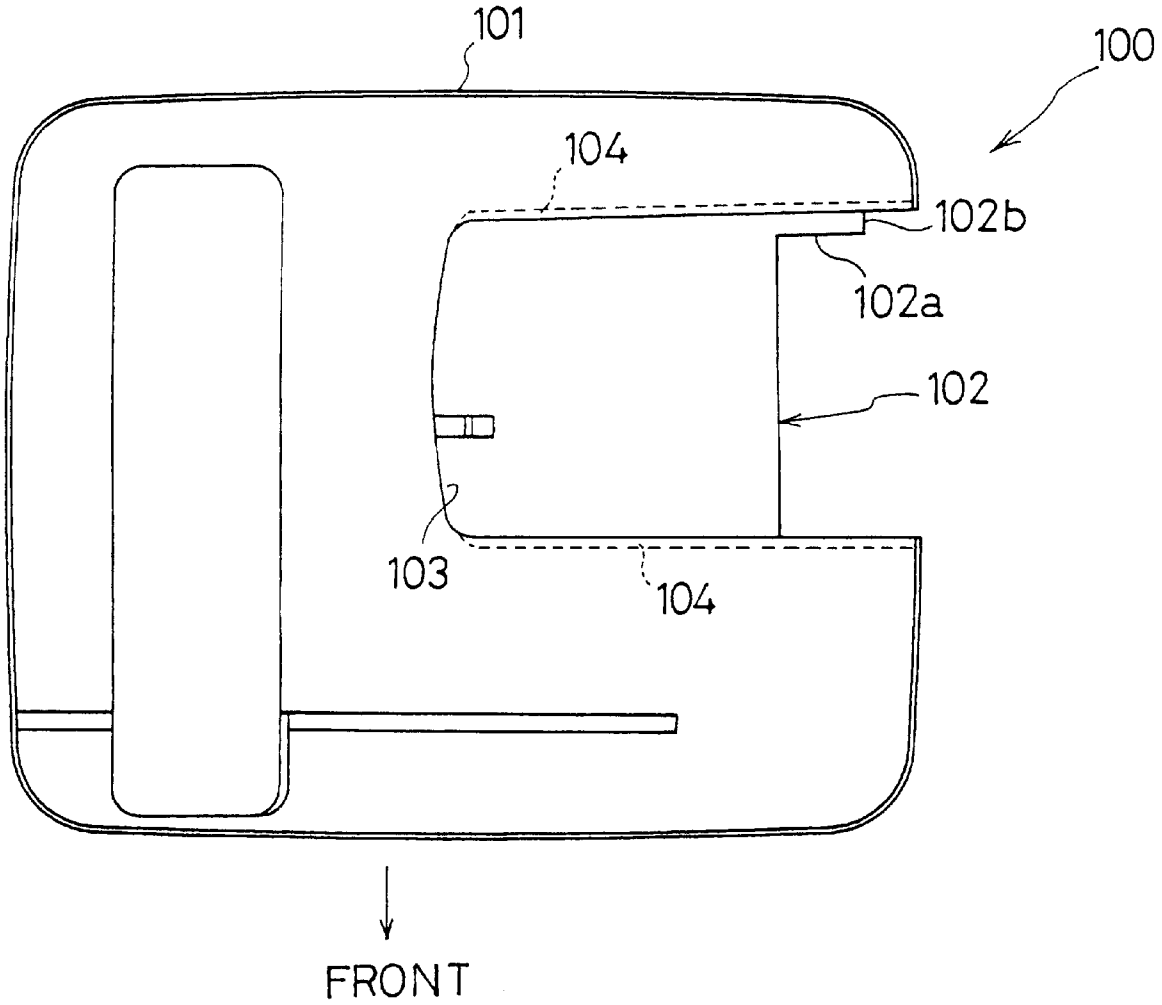
FIG. 3 is a plan view of a cloth feeding unit.

As shown in FIG. 3, the main body case 101 of the cloth feeding unit 100 is formed substantially in a rectangular shape when viewed in plan. Substantially an upper half portion of the main body case 101 is formed with a notched opening 103. A bottom portion of the main body case 101 is closed by a horizontal wall portion 102 which engages a lower side of the free arm portion 1*a* for introducing the free arm portion 1*a*. The main body case 101 is also formed with engaging portions 104 slidably engaged in guide grooves on both side portions of the bed portion 1 to correspond with both sides (top (rear) bottom (front) as shown in FIG. 3) of the notched opening 103.

Figure 2:
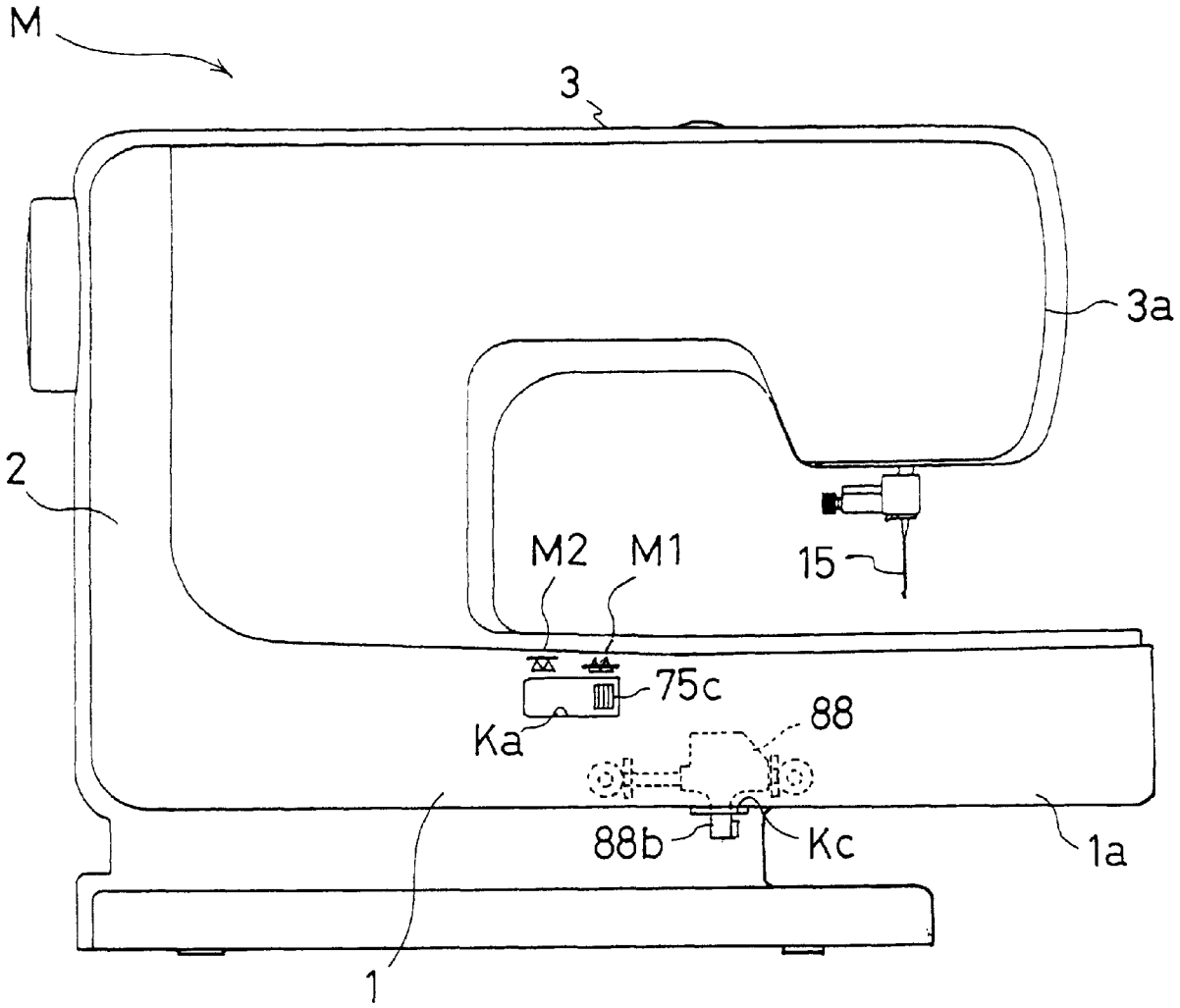
FIG. 2 is a rear view of the electronic control type sewing machine.

Further, as shown by FIGS. 1 through 3, a rear side (top as viewed in FIG. 3) of the right end portion (FIGS. 1 and 3) of the horizontal wall portion 102 is formed with a contact portion 102*a* which is brought into contact with the bed portion 1 at the rear side in a projected shape. A right end portion of the contact portion 102*a* is formed with a pressing portion 102*b* for engaging a moving member 88 of a feed dog drop mechanism 70, mentioned later, when the cloth feeding unit 100 is mounted to the sewing machine M. Further, an embroidery frame 105 for holding the work-cloth is driven to move in a X-direction (left and right direction) and a Y-direction (forward and rearward direction) independently from each other by an X drive mechanism driven by an X direction drive motor and a Y drive mechanism driven by a Y direction drive motor, not illustrated.

As shown by FIGS. 4, 7, 8 and 9, the inside of the electronic control type sewing machine M has installed therein a main motor (sewing machine motor) 6, a main shaft 7 driven to rotate by the main motor 6, a drive shaft 8 cooperatively connected to the main shaft 7, a needle bar vertically moving mechanism 20 for driving a needle bar 14 in the up and down direction, a feed dog horizontally moving mechanism 50 (FIG. 9) for driving the feed dog 40 in the forward and rearward direction, a feed dog vertically driving mechanism 55 for driving the feed dog 40 in the up and down direction, a feed dog drop mechanism 70 for switching the feed dog 40 to an escape state, and a shuttle drive mechanism 95 for driving a horizontally rotating shuttle 90 for forming a thread ring of the upper thread in synchronism with the sewing needle 15. The details of the various mechanisms are discussed below.

The main shaft 7 is arranged in the arm portion 3 and is rotatably supported by a pair of ball bearings 7*a* attached to a frame F made by die casting arranged vertically in a machine cover K. A right end portion of the main shaft 7 is fixedly attached with a timing pulley 9, a timing belt 11 is mounted to extend between the timing pulley 9 and a timing pulley 10 fixedly attached to an output shaft of the main motor 6. The main shaft 7 is driven to rotate in a predetermined rotational direction via the two timing pulleys 9, 10 and the timing belt 11 by the main motor 6.

Mounted at the inside of the head portion 3*a* at the left end portion of the arm portion 3 is a needle bar supporter 13, an end portion of which is axially supported by the frame F swingably in the left and right direction. The needle bar 14 is supported by the needle bar supporter 13 movably in the up and down direction and the sewing needle 15 is attached to a lower end of the needle bar 14. The needle bar 14 is driven to swing by a needle bar swinging motor (not illustrated) via the needle bar supporter 13.

An explanation will be given of the needle bar vertically moving mechanism 20. A crank member 21 is fixedly attached to a left end portion of the main shaft 7, the needle thread take up 23 is attached to the crank member 21, an upper end portion of a crank lever 22 is coupled to the crank member 21 by a pin and a lower end portion of the crank lever 22 is connected to a middle portion of the needle bar 14. Thereby, when the main shaft 7 is driven to rotate by the main motor 6, the needle bar 14 is driven in the up and down direction via the crank member 21 and the crank lever 22. Simultaneously therewith, the needle thread take up 23 is also driven in the up and down direction. The needle bar vertically moving mechanism 20 and the shuttle drive mechanism 95 are operated synchronously with each other and the needle bar 15 and the horizontally rotating shuttle 90 are operated in synchronism with each other to thereby form a seam in the work-cloth on the bed face.

The drive shaft 8 is arranged vertically in the pedestal portion 2 and is rotatably supported by a pair of ball bearings 8*a* attached to the frame F. A bevel gear 16 is fixedly attached to an upper end portion of the drive shaft 8. The bevel gear 16 meshes with a bevel gear 17 fixedly attached to the main shaft 7. Thus, the drive shaft 8 is cooperatively connected to the main shaft 7 by the pair of bevel gears 16, 17.

Figure 5:
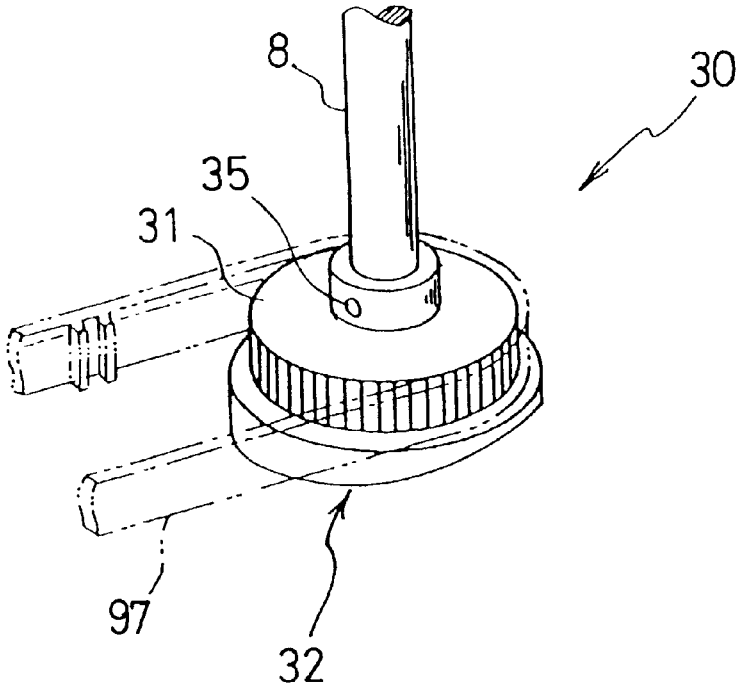
FIG. 5 is a perspective view of a cam member.
Figure 6:
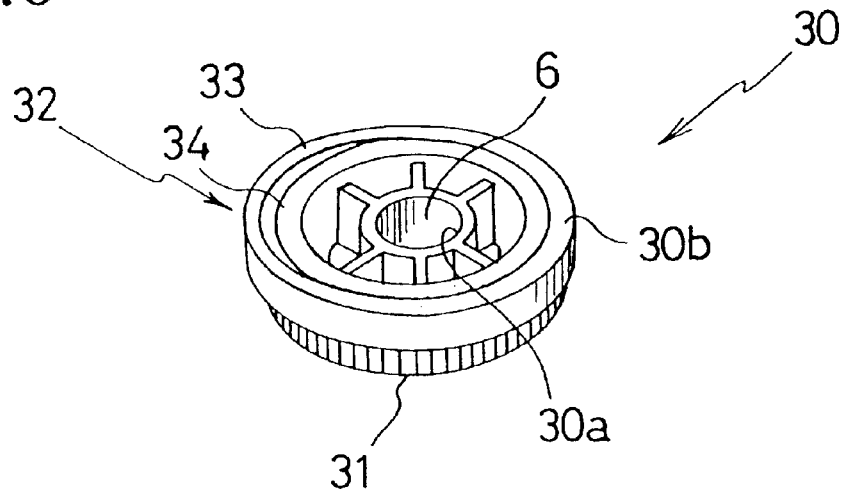
FIG. 6 is a perspective view of the cam member from a bottom face side thereof.

Next, an explanation will be given, using FIGS. 5 and 6, of a cam member 30, which is fixedly attached concentrically to the drive shaft 8 in the vicinity of a lower end portion of the drive shaft 8.

The cam member 30 is made of synthetic resin and is integrally formed with a timing pulley 31 for drivingly rotating the horizontally rotating shuttle 90 and a feed dog vertically driving cam 32 for driving the feed dog 40 in the up and down direction. A central portion of the cam member 30 is formed with an insertion hole 30*a*. The lower end portion of the drive shaft 8 is fitted into the insertion hole 30*a* and is fixed thereto by a pin 35 such that both cannot rotate relative to each other.

The diameter of the timing pulley 31 is formed to be smaller than an outer dimension of the feed dog vertically driving cam 32 on a lower side thereof. A vertically driving cam (cam face) 33 used in normal sewing operations is formed at an outer peripheral portion on a lower face side of the feed dog vertically driving cam 32 and an escape driving cam (cam face) 34 for vertically driving the feed dog 40 by a very small stroke while maintaining the feed dog 40 in the drop state is contiguous to an inner peripheral side of the vertically driving cam 33. In this case, the diameter of the outer peripheral portion of the feed dog vertically driving cam 32 is formed larger than the diameter of the timing pulley 31 and a timing belt 97 mounted on the timing pulley 31 is supported by the outer peripheral portion of the feed dog vertically driving cam 32.

The vertically driving cam 33 and the escape driving cam 34 of the feed dog vertically driving cam 32 are concentrically and integrally formed centering on the axis center of the drive shaft 8 and a communicating portion 30*b* which constitutes the same plane (same height position) for a portion of the two driving cams 33, 34.

Next, an explanation will be given of the feed dog horizontally driving mechanism 50 for driving the feed dog 40 installed in the vicinity of the left end portion of the bed portion 1 in the forward and rearward direction and the feed dog vertically driving mechanism 55 for driving the feed dog 40 in the up and down direction.

As shown by FIGS. 7 through 10, the feed dog 40 is attached to an upper end portion of a feed base 41 having a pair of horizontal support plates 41*a* and 41*b*. A vertical axially supporting pin 42 is inserted through the pair of the support plates 41*a*, 41*b* of the feed base 41 to be movable in the up and down direction, a central portion of the axially supporting pin 42 is fixedly attached to a left end portion of a swing member 46 and the feed base 41 is driven to reciprocate in the forward and rearward direction by swinging the swinging member 46. An extension portion 41*c* is extended from the support plate 41*b* on the lower side in the forward direction, an elongated hole 41*d*, formed at a front end portion of the extension portion 41*c*, is engaged with an engaging pin 44 projected upward from a support plate 43 attached to the frame F. The feed base 41 reciprocates in the forward and rearward direction while restricting pivotal movement thereof.

Figure 7:
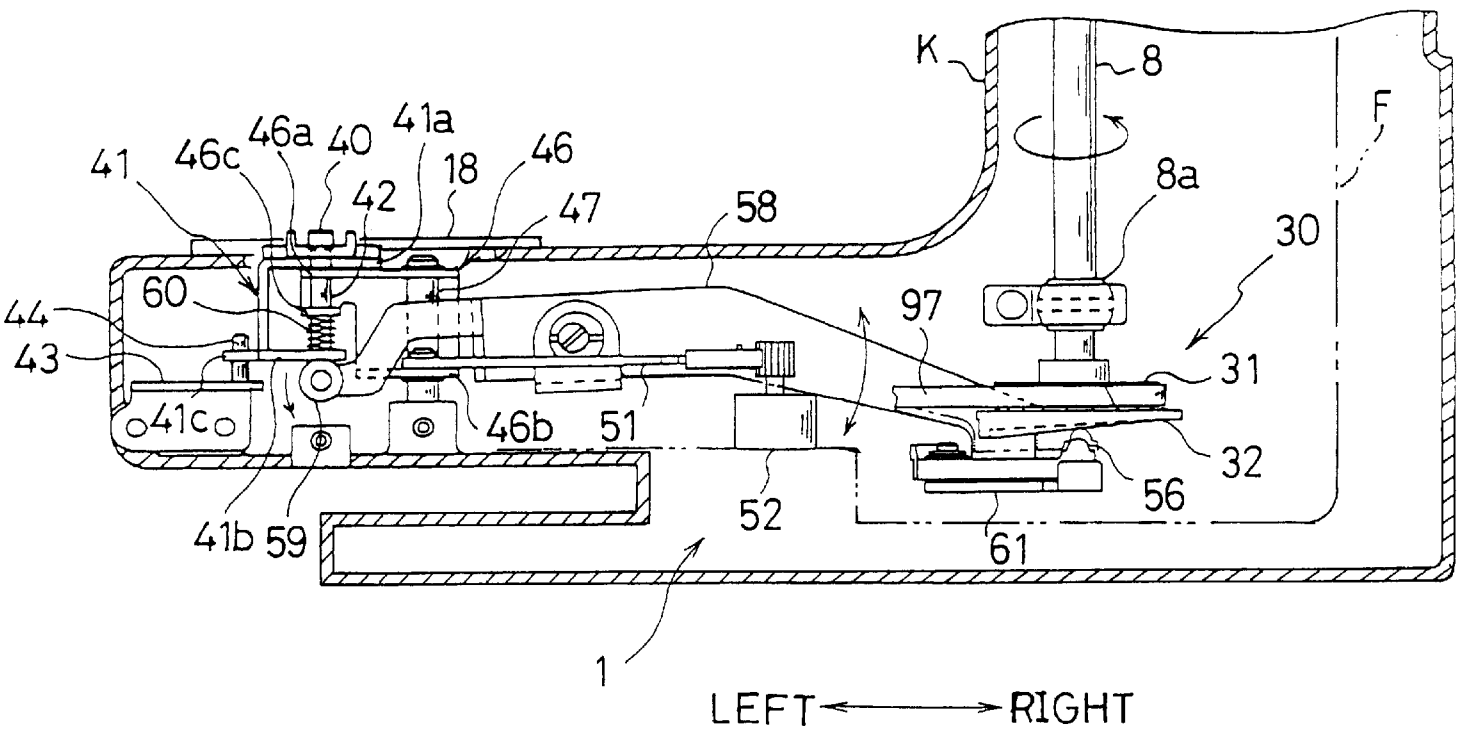
FIG. 7 is a front, partially sectional view showing an inner structure of a bed portion.

The swing member 46 is formed substantially in a channel-like shape when viewed from the right side, by connecting a pair of horizontal swing plates 46*a*, 46b (FIG. 7). The right end portions of the swing plates 46*a*, 46*b* are axially supported by a vertical axially supporting shaft 47 fixedly attached to the frame F. A horizontal plate 46*c* integral with the swing member 46 projects so as to oppose the swing plate 46*a* on the lower side of a left end portion of the swing plate 46*a*. The axially supporting pin 42 is inserted through the left end portion of the swing plate 46*a* and the horizontal plate 46*c* and its central portion is fixedly attached thereto.

Figure 9:
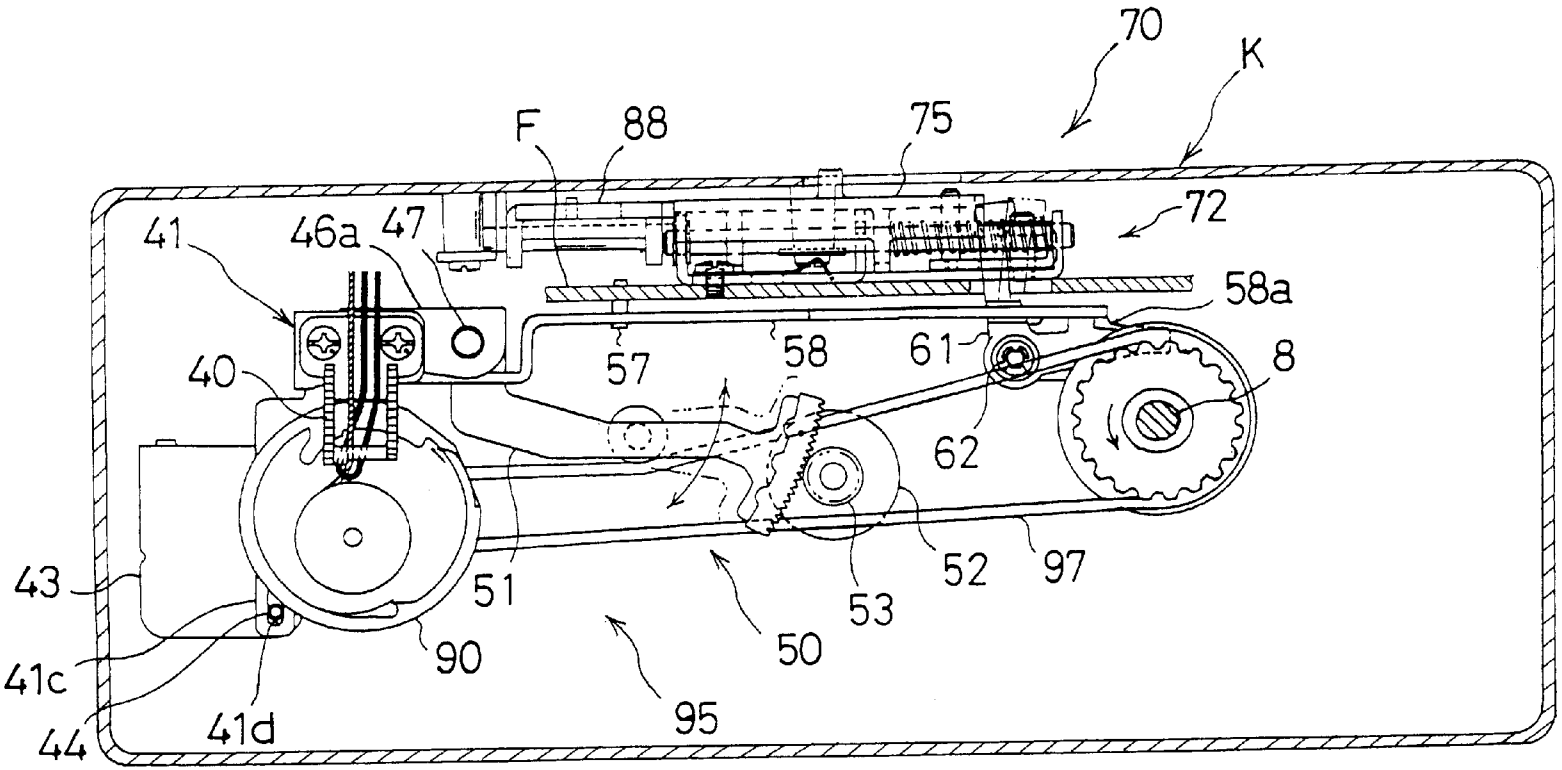
FIG. 9 is a plan, partially sectional view showing an inner structure of the bed portion including the horizontally moving shuttle.

As shown by FIG. 9, the feed dog horizontally driving mechanism 50 comprises the swing member 46, a forwardly and rearwardly moving link 51 connected integrally to the swing member 46, supporting shaft 47 and a motor 52 for driving forwardly and rearwardly to thereby swing the forwardly and rearwardly moving link 51.

A teeth portion at a right end portion of the forwardly and rearwardly moving link 51 is in mesh with a drive gear 53 fixedly attached to a drive shaft of the motor 52 for forwardly and rearwardly driving the feed dog which is installed contiguous to the forwardly and rearwardly moving link 51.

That is, in FIG. 9, when the motor 52, for forwardly and rearwardly driving the feed dog, is rotated in the counterclockwise direction, the forwardly and rearwardly moving link 51 and the swing member 46 are pivoted in the clockwise direction with the axially supporting shaft 47 as a pivotal center to thereby rearwardly drive the feed dog 40. At this time, the feed dog 40 is elevated upward from the needle plate 18 by about 1 mm by the feed dog vertically driving mechanism 55 and the forwardly and rearwardly driving motor 52 is driven to rotate in accordance with a cloth feed amount by the feed dog 40. When the forwardly and rearwardly driving motor 52 is rotated in the clockwise direction, the forwardly and rearwardly moving link 51 and the swing member 46 are pivoted in the counterclockwise direction and the feed dog 40 is driven in the forward direction. At this time, the feed dog 40 is lowered to a lowered position lowered from the needle plate 18 by about 1 mm.

The feed dog vertically driving mechanism 55 comprises the drive shaft 8, the vertically driving cam 33 of the cam member 30 fixed to the drive shaft 8, a follower 56 capable of being brought into contact selectively with the horizontally driving cam 33 and the escape driving cam 34, a vertically moving link 58 attached to the follower 56 at its right end portion and pivotally supported on the frame F by a pin 57. The vertically moving link 58 is formed as a flat plate having an angled shape, in front view, and extends in the left and right direction toward the rear side of the bed portion 1.

A left end portion of the vertically moving link 58 has a caster 59 rotatably mounted thereto. The caster 59 is brought into contact with a lower face of the support plate 41*b* of the feed base 41. In this embodiment, a compression helical spring 60 is externally mounted to the axially supporting pin 42 between the support plate 41*b* and the horizontal plate 46*c*. Due to the urging force of the compression helical spring 60, the feed base 41 is always pressed against the caster 59 and the feed dog 40 is driven upwardly and downwardly following the upward and downward movement of the caster 59 on the end of vertically moving link 58.

A right end portion of the vertically moving link 58 is formed with a follower supporting portion 58*a* formed to bend in the forward direction substantially in the horizontal state.

As shown by FIGS. 7 and 9, the follower supporting portion 58*a* is axially supported pivotably with a base end portion of a switch lever 61, substantially in an L-like shape in plan view, by a pin 62. The follower 56 is upwardly and fixedly attached to an operating portion 61*a* (FIG. 11) of the switch lever 61. The switch lever 61 is normally disposed at a vertically moving position shown in bold lines by the spring force of a tension helical spring 81, mentioned later. That is, the follower 56 is brought into contact with the vertically driving cam 33 from the lower side via the vertically moving link 58 by the urging force of the compression helical spring 60, mentioned above. Thereby, by rotating the drive shaft 8, the vertically driving cam 33 is simultaneously rotated and, accordingly, the follower 56 is moved upwardly and downwardly along the cam face of the vertically driving cam 33.

Figure 10:
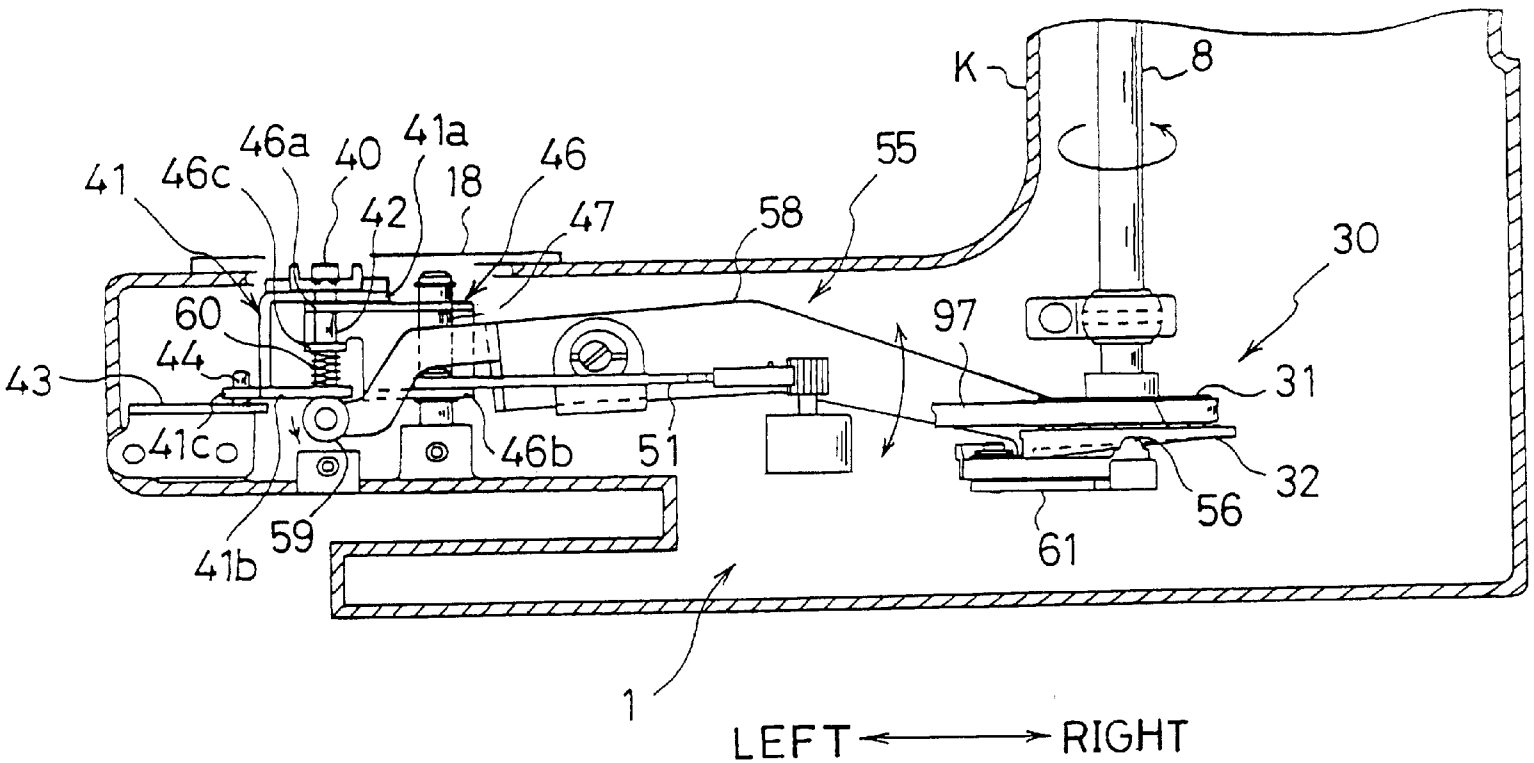
FIG. 10 is a view corresponding to FIG. 7 where a feed dog is brought into an escape state.

As a result, as shown by FIG. 7, the feed dog 40 is moved to an elevated position upward from the upper face of the needle plate 18 by about 1 mm via the pivotal movement of the vertically moving link 58. Alternatively, as shown by FIG. 10, the feed dog 40 is moved to a lowered position downward from the upper face of the needle plate 18 by about 1 mm. Incidentally, the feed dog 40 is regularly fed at the elevated position and reversely fed at the lowered position to thereby constitute what is called a four feed motion.

Next, an explanation will be given of the feed dog drop mechanism 70.

Figure 11:
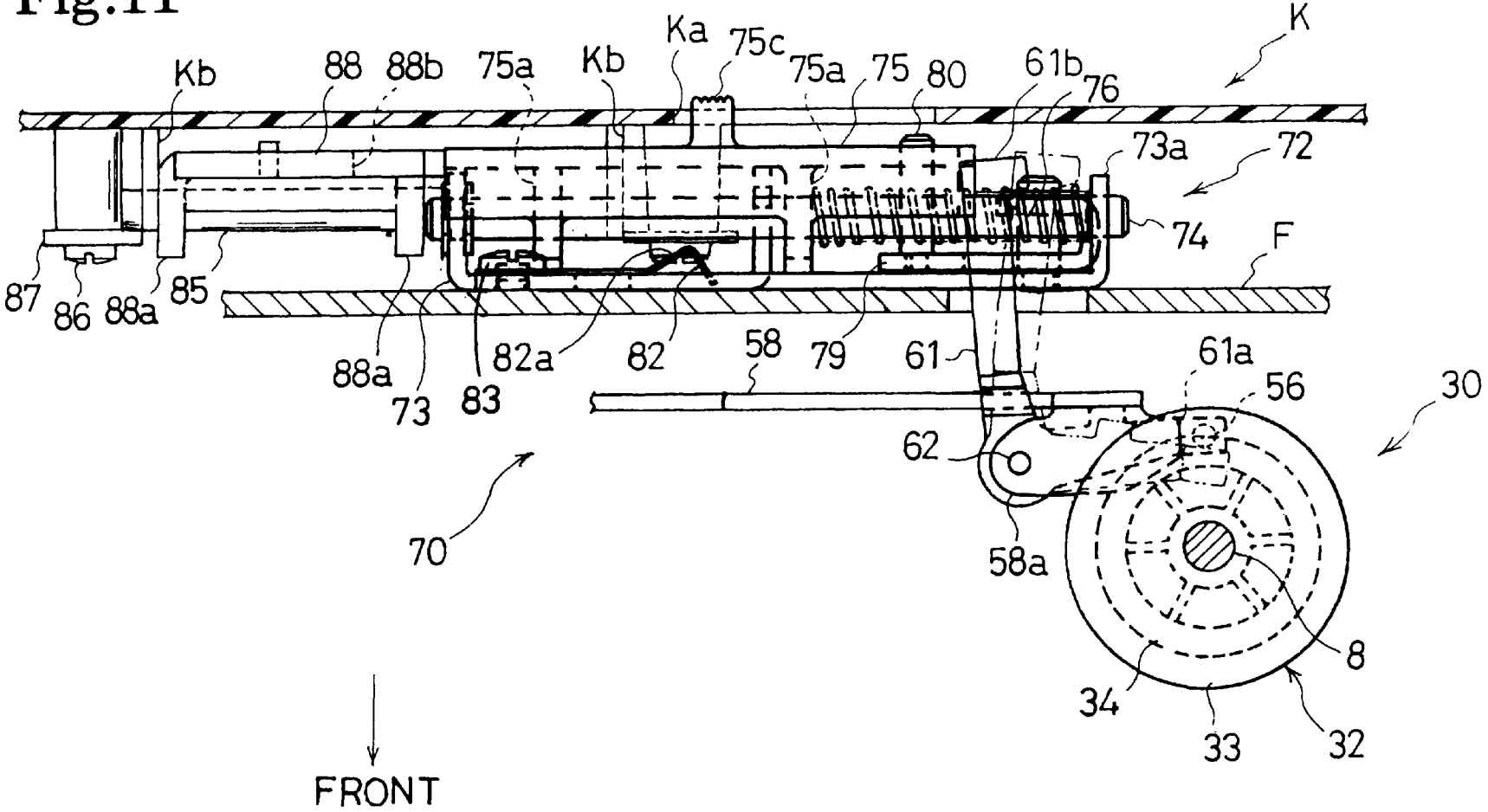
FIG. 11 is a plan, partially sectional view partially enlarging FIG. 9.

As mentioned above, the follower 56 is fixedly attached to the front end of the operating portion 61*a* of the switch lever 61 supported pivotably by the follower support portion 58*a* of the vertically moving link 58. A drive portion 61*b* thereof extends rearward from the frame F and is connected to a lower end portion of a pivoting lever 79 of a switch operating unit 72, explained below. That is, as shown by FIG. 11, in response to pivotal movement of the pivoting lever 79, the switch lever 61 is switched from a drive position shown by bold lines to a drop position shown by chain lines and the follower 56 is switched from the vertically driving cam 33 to a position in correspondence with the escape driving cam 34.

Next, an explanation will be given of the switch operating unit 72 with reference to FIGS. 9, 11 and 12.

A unit frame 73, having a substantially rectangular shape in rear view, is connected to the frame F from a rear face side thereof by screws. A pair of support portions 73*a*, formed by bending left and right end portions of the unit frame 73 in the rearward direction, are fixedly attached with the left and right end portions of a support shaft 74 directed in the left and right direction. At the support shaft 74, a slide member 75 having a rectangular shape and comprising a plate member made of synthetic resin and formed with ribs for reinforcement at its outer peripheral portion, is movably supported by inserting the support shaft 74 into support portions 75*a* at two locations on the slide member 75 and integrally formed therewith.

In this case, by respectively bringing the front ends of two upper and lower contact portions 75b, integrally formed with the slide member 75, into contact with the unit frame 73 from the rear side by which the slide member 75 is made movable while maintaining an attitude substantially in parallel with the unit frame 73. Further, a compression helical spring 76 is externally mounted to the support shaft 74 between the support portion 73*a* and the support portion 75*a* and the slide member 75 is elastically urged always in the left direction (FIG. 11) by the spring force of the helical spring 76. A pivoting slit 77 comprising an inclined slit 77*b* inclined to and connecting horizontal slits 77*a*, 77*c* is formed (as viewed in FIG. 12) at substantially the right half and a lower end portion of the slide member 75.

Figure 12:
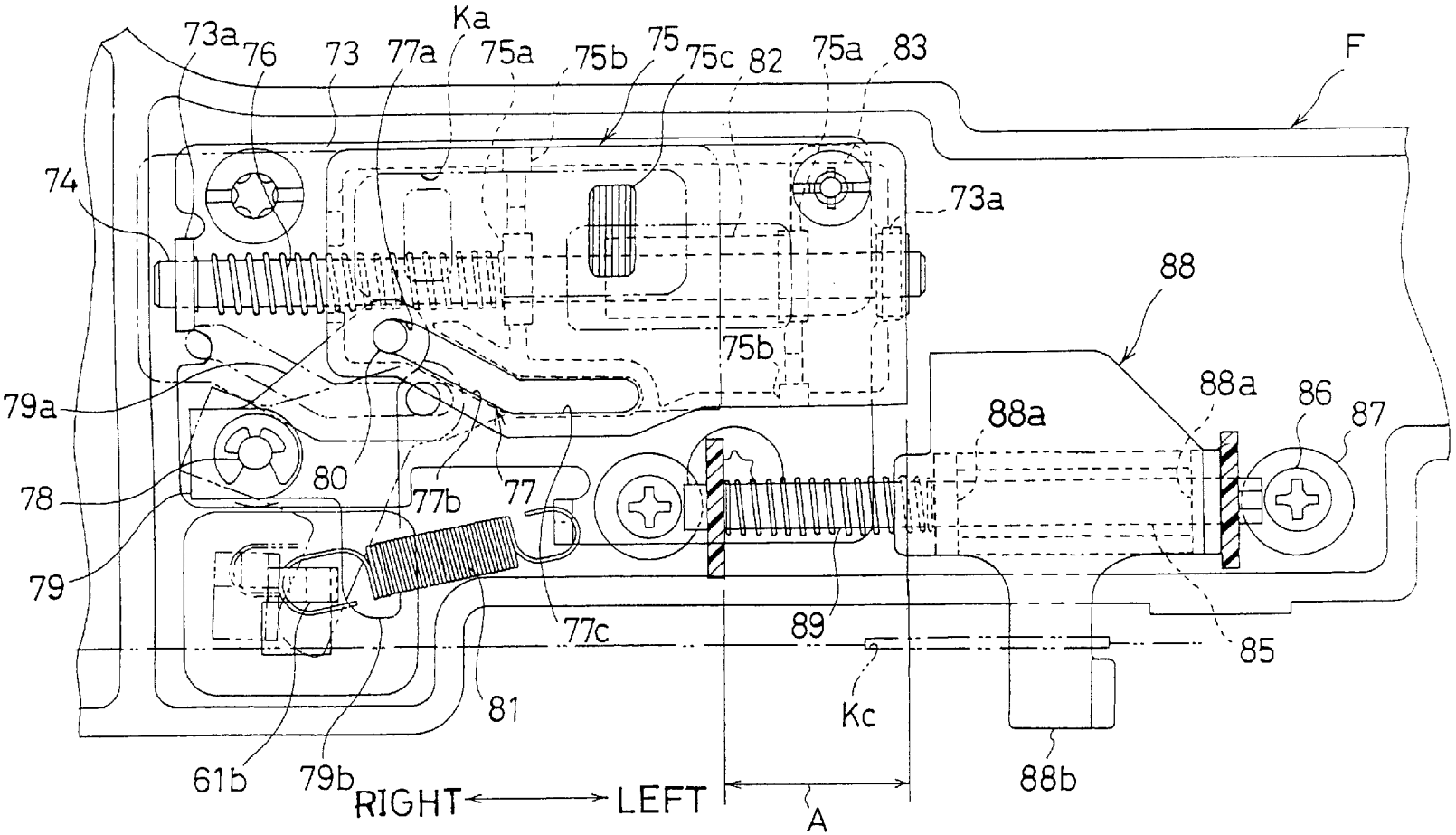
FIG. 12 is a rear view showing the inner structure of the bed portion.

Meanwhile, as seen in FIG. 12, a front end of an axially supporting pin 78 extending rearwardly is fixedly attached to a right lower corner portion of the unit frame 73. A base end portion of the pivoting lever 79, formed to bend substantially in a channel-like shape in plan view, is axially pivotably supported by the axially supporting pin 78. A front end of an engaging pin 80 that extends rearwardly is fixedly attached to the front end portion of the drive portion 79*a* extended in an upwardly skewed direction of the pivoting lever 79. The engaging pin 80 is engaged with the pivoting slit 77. Further, the operating portion 79*b* extending downwardly from the pivoting lever 79 is disposed to be brought into contact with a rear end portion of the drive portion 61b of the switch lever 61.

That is, the slide member 75 is normally movable between a feed dog operating position which is a leftmost position where the engaging pin 80 is brought into contact with the right end of the horizontal slit 77*a*, on the upper side, as shown by the bold lines by spring force of the compression helical spring 76. The feed dog manual drop position is the rightmost position where the engaging pin 80 is brought into contact with the left end of the horizontal slit 77*c* on the lower side via the inclined slit 77*b*. During a time period in which the slide member 75 is moved from the feed dog operating position to the feed dog manual drop position and the engaging pin 80 moves in the inclined slit 77*b*, the pivoting lever 79 is pivoted via the engaging pin 80 from a standby position shown by bold lines to an operating position shown by chain lines and the switch lever 61 is switched to the drop position. In this case, the maximum moving distance of the slide member 75 from the feed dog operating position to the feed dog manual drop position is designated by notation A.

As shown in FIG. 12, a tension helical spring 81 extends between the drive portion 61*b* of the switch lever 61 and the unit frame 73. The switch lever 61 is always urged to switch to the vertically moving position by the spring force of the helical spring 81.

Figure 13:
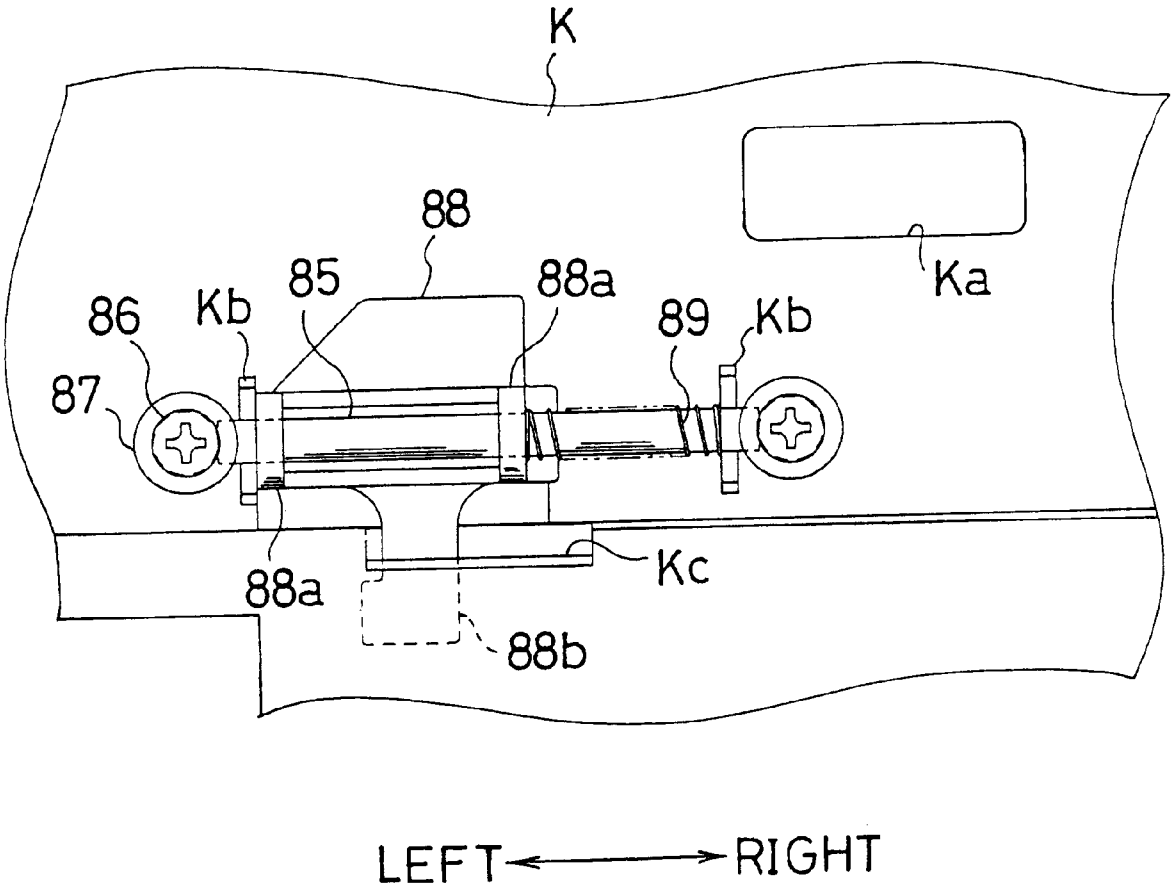
FIG. 13 is a partially enlarged view of an inner portion of a machine cover at the bed portion.

As shown in FIGS. 12 and 13, the machine cover K in correspondence with the rear side of the slide member 75, is formed with a notched window Ka having a rectangular shape elongated in the left and right direction. An operating portion 75*c* projects rearwardly from a rear end face of the slide member 75 to project out (rearwardly) of the notched window Ka in an exposed state. Using the operating portion 75*c*, the slide member 75 can be switched between the feed dog operating position and the feed dog manual drop position.

Figure 15:
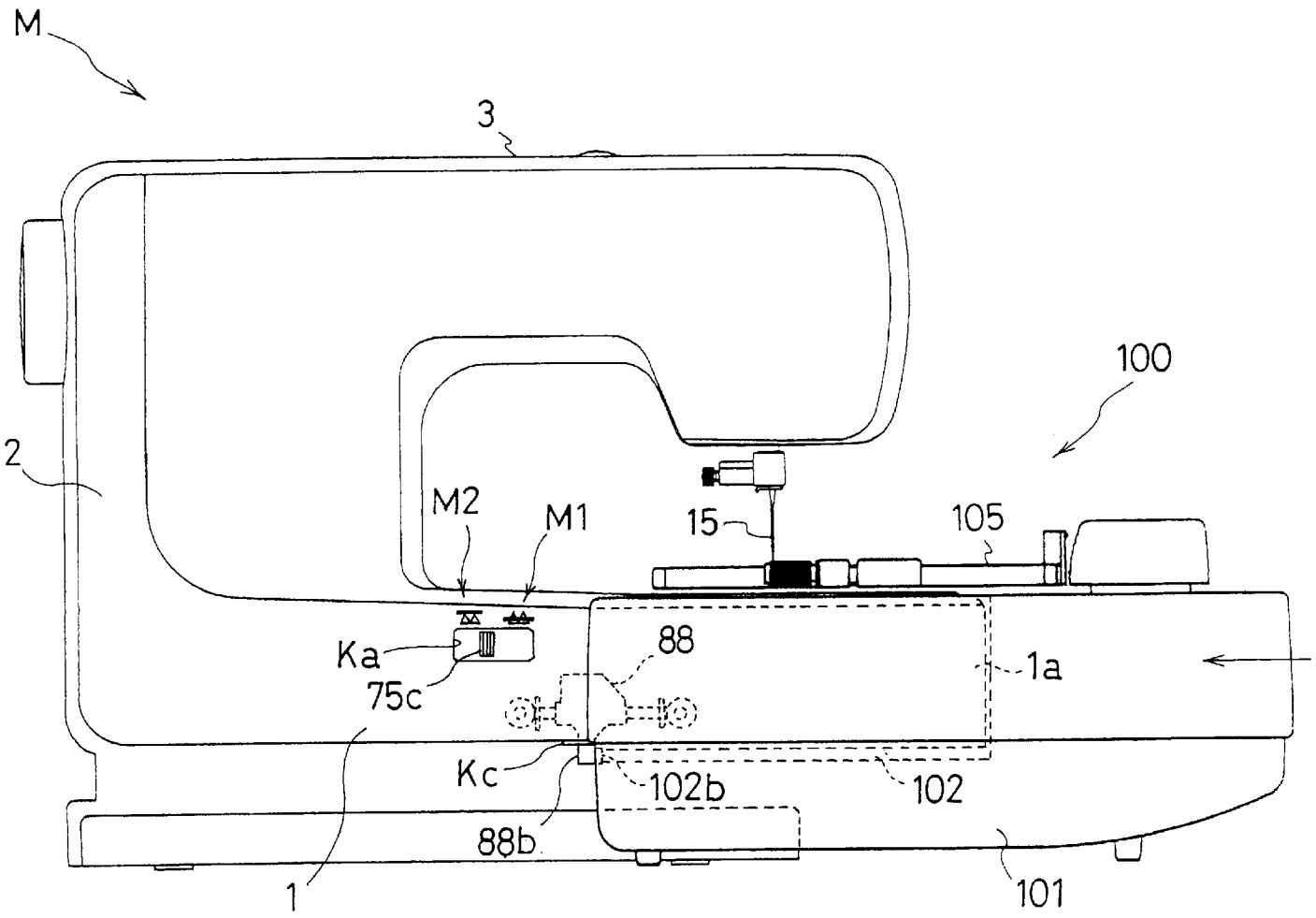
FIG. 15 is a view corresponding to FIG. 2 in which the cloth feeding unit is mounted.

Further, as shown by FIGS. 2 and 15, an upper side of an outer face of the machine cover K formed with the notched window Ka is inscribed with a mark Ml indicating where the feed dog 40 moves upwardly and downwardly relative to the needle plate 18 (horizontal bar) in correspondence with a position of the operating portion 75*c* at the feed dog operating position and a mark M2 where the feed dog 40 drops to a lower side of the needle plate 18 (horizontal bar) in correspondence with a position of the operating portion 75*c* at the drop position of the feed dog 40.

A base end portion (left end portion) of a leaf spring 82 is fixedly attached by a screw 83 to the unit frame 73 in correspondence with substantially an upper half portion of the slide member 75. A lock portion 82*a* projected rearwardly in a triangular shape, is formed at a right end portion of the leaf spring 82.

Thereby, when the operating portion 75*c* is operated manually to move the slide member 75 to the feed dog manual drop position, that is, when the support portion 75*a* rides over the lock portion 82*a*, the slide member 75 is maintained at the feed dog manual drop position since the elastic force of the leaf spring 82 is stronger than the spring force of the compression helical spring 76. As a result, the escape driving cam 34 is rotated simultaneously with rotation of the drive shaft 8 and, accordingly, the follower 56 moves along the cam face of the escape driving cam 34 and the feed dog 40 is elevated by a very small stroke from the drop position to a height substantially equal to the height of the upper face of the needle plate 18. Thus, the operating system for operating the feed dog drop mechanism 70 comprises the pivoting slit 77, the engaging pin 80, the pivoting lever 79, and the switch lever 61.

At an inner face of the machine cover K, to the left of and below the notched window Ka, as shown in FIGS. 11 through 13, the left and right end portions of a support shaft 85, oriented in the left and right direction, are supported by front end portions of a pair of support portions Kb formed in the machine cover K and fixed to prevent detachment by washers 87 of fixing bolts 86. A moving member 88 is movably supported on the support shaft 85 for movement in the left and right direction by inserting the support shaft 85 through two support portions 88*a* integrally formed with the moving member 88. The moving member 88 is formed with a contact portion 88*b* extended downwardly. As shown in FIGS. 2 and 15, almost all of the contact portion 88*b* extends outwardly from a slit Kc formed at a stepped portion of a recessed side wall portion produced by recessing the side wall of the machine cover K to an inner side so that the contact portion 88*b* can be seen at all times by an operator.

Further, a compression helical spring 89 is mounted to the support shaft 85 between the support portion Kb on the right side and the moving member 88. The moving member 88 is disposed normally at a left standby position (refer to FIGS. 12 and 13) by the spring force of the compression helical spring 89. Further, when the cloth feeding unit 100 is mounted to the free arm portion 1*a*, the contact portion 88*b* is pressed to move in the right direction (relative to the front of the sewing machine) by a pressing portion 102*b* of the cloth feeding unit 100 and is moved from a standby position shown in bold lines in FIG. 17 to a pressing position shown in chain lines in accordance with a movement distance B. Simultaneously therewith, the slide member 75 is pressed by the moving member 88 from the left side and is moved to the feed dog automatic drop position (chain line in FIG. 17) in front of the feed dog manual drop position. In this case, the slide member 75 and the moving member 88 correspond to pressed portions.

That is, the slide member 75 is moved from the feed dog operating position to the feed dog automatic drop position in correspondence with the movement distance B of the moving member 88. In this case, although the movement distance B of the slide member 75 from the feed dog operating position is slightly shorter than the maximum movement distance A moved in manual operation, the engaging pin 80 is firmly moved in the inclined slit 77*b*, the pivoting lever 79 is pivoted to the operating position and the switch lever 61 is firmly switched to the drop position. As a result, the follower 56 is firmly switched to the position in correspondence with the escape driving cam 34.

Figure 8:
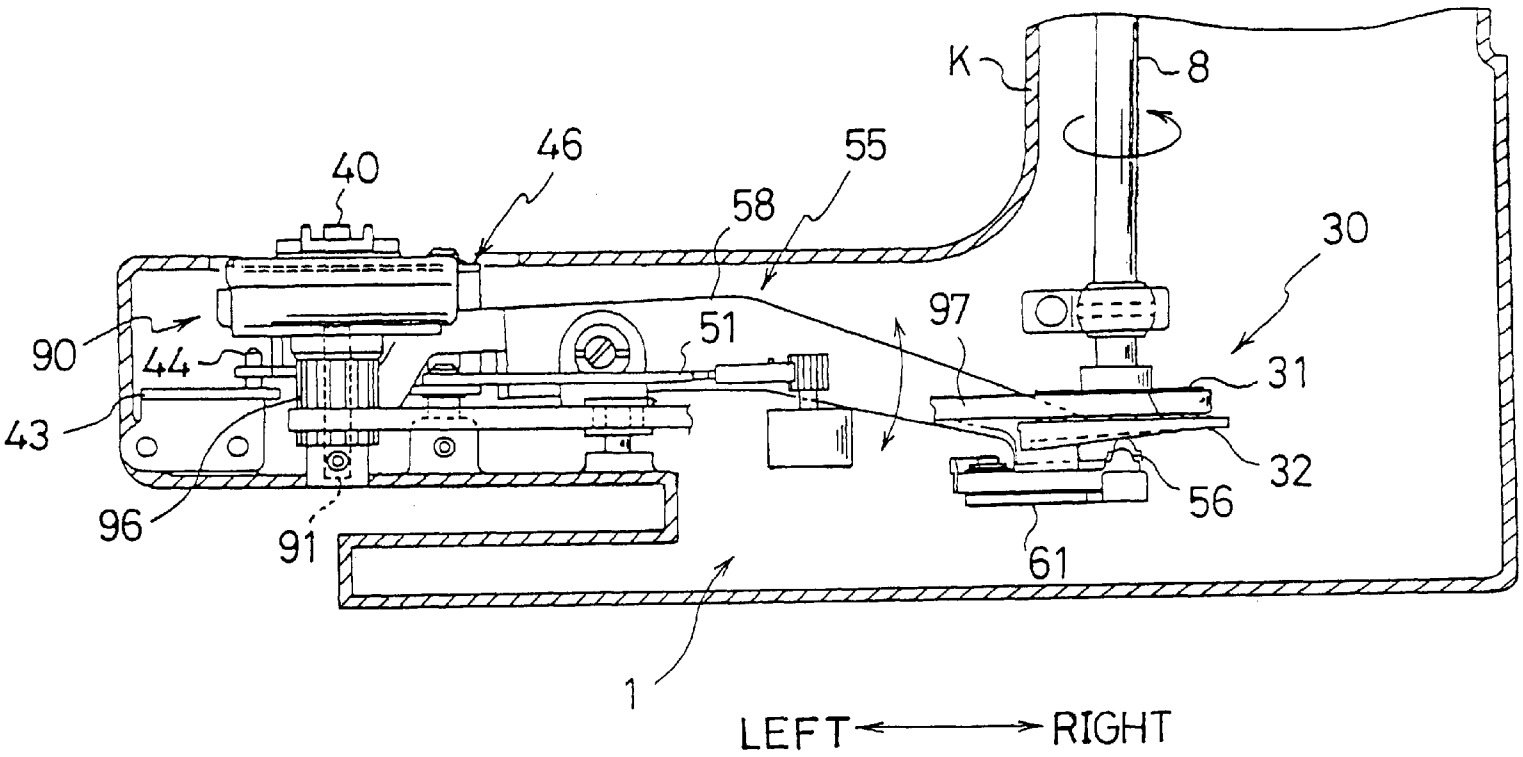
FIG. 8 is a view corresponding to FIG. 7 including a horizontally moving shuttle.

Meanwhile, as shown by FIGS. 8 and 9, the horizontally rotating shuttle 90 is axially supported pivotably around a vertical axis center at a shuttle shaft 91 directed in the vertical direction. A lower end portion of the shuttle shaft 91 is fixedly attached to the frame F in the vicinity of the left end portion of the bed portion 1.

Next, an explanation will be given of the shuttle drive mechanism 95. A timing pulley 96 is integrally formed with a lower portion of the rotating shuttle 90. The Liming belt 97 extends between the timing pulley 96 and the timing pulley 31 of the cam member 30. The cam member 30 is driven to rotate along with the drive shaft 8. The shuttle 90 is driven to rotate via the timing pulleys 31, 96 and the timing belt 97.

Incidentally, by having a difference between the diameters of the timing pulleys 31, 96, the rotating shuttle 90 is driven to rotate at a rotational speed twice that of the drive shaft 8 to form a seam in a work-cloth in cooperation with the sewing needle 15.

Next, an explanation will be given of the operation and effect of the electronic control type sewing machine M and the cloth feeding unit 100 structured in this way.

As shown by FIG. 2, when the operating portion 75*c* of the slide member 75 is not operated and the slide member 75 is at the feed dog operating position, it can be observed by the operator that the operating portion 75*c* is disposed in correspondence with the mark Ml showing the vertically moving position of the feed dog 40.

That is, at this time, the pivoting lever 79 is at the standby position, the switch lever 61 is switched to the vertically moving position and the follower 56 is brought into contact with the vertically driving cam 33. When the main motor 6 is driven in this state, the needle bar 14 is driven upwardly and downwardly via the main shaft 7 and the needle bar vertically driving mechanism 20. Simultaneously, the cam member 30 is driven to rotate by rotation of the drive shaft 8, the follower 56 is moved upwardly and downwardly by the vertically driving cam 33 and, accordingly, the feed dog 40 is driven upwardly and downwardly relative to the upper side and the lower side of the needle plate 18 via the feed dog vertically driving mechanism 55. Simultaneously therewith, the work-cloth is fed by the so-called four feed motion accompanied by the forward and rearward driving by the feed dog horizontally driving mechanism 50.

Figure 14:
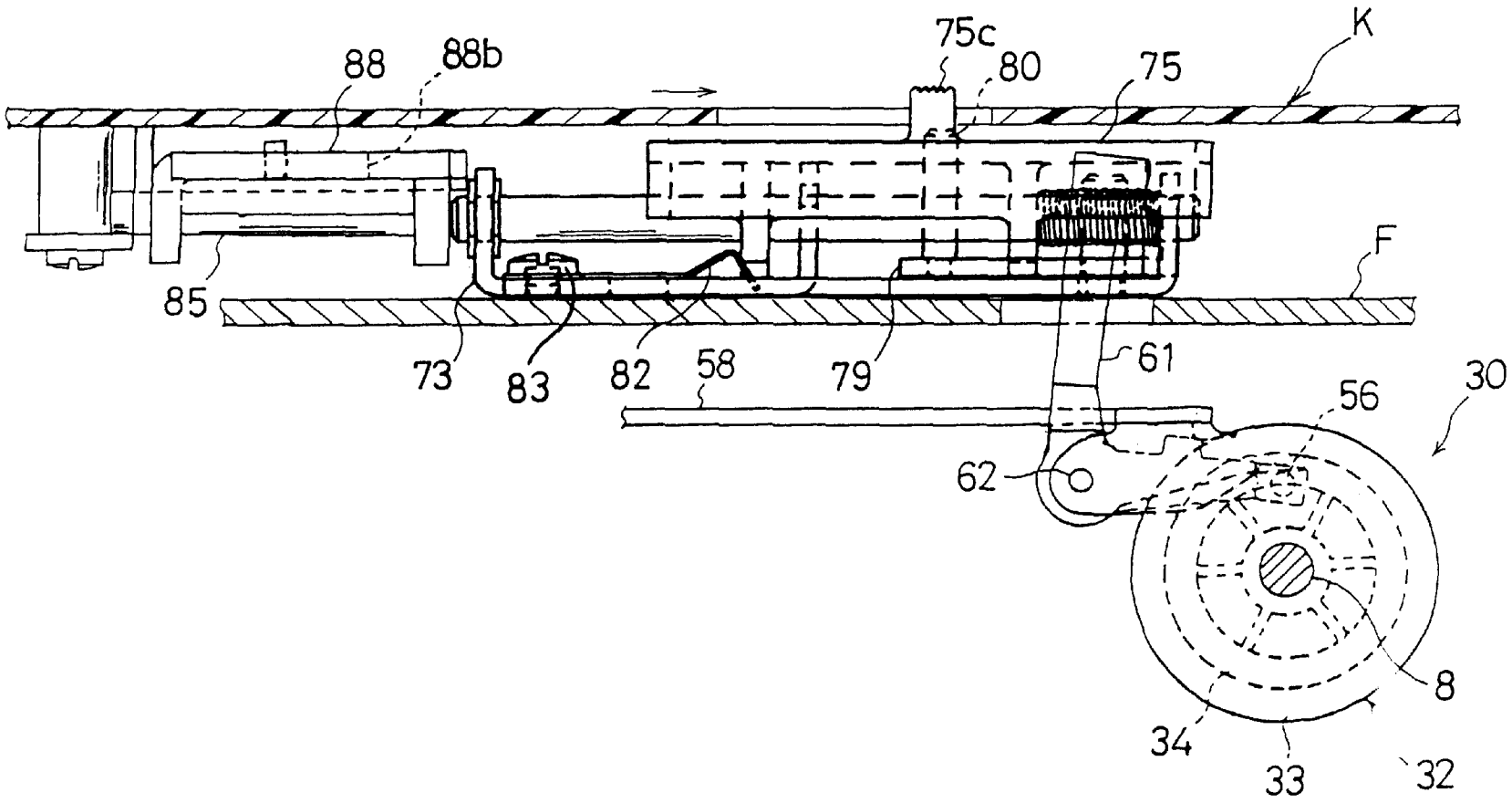
FIG. 14 is a view corresponding to FIG. 11.

Conversely, when basting or the like is executed by elevating the press foot and moving the feed dog 40 into a drop state, shown by FIGS. 10 and 14, by operating the operating portion 75*c* of the slide member 75, the slide member 75 is switched to the feed dog manual drop position where the slide member 75 is moved by the maximum moving distance A. As a result, as shown by chain lines in FIG. 12, the operator can see the operating portion 75*c* is disposed in correspondence with the mark M2 indicating the drop position of the feed dog 40 and switching of the feed dog 40 to the drop position can easily be confirmed. Thereby, by moving the slide member 75 Lo the feed dog manual drop position, the pivoting lever 79 is pivoted to the operating position via the engaging pin 80 and the inclined slit 77*b*, at the same time, the switch lever 61 is switched to the drop position and the follower 56 is switched to the position in correspondence with the escape driving cam 34.

When the main motor 6 is driven in this state, the cam member 30 is driven to rotate and the feed dog 40 is finely moved by a very small stroke at the drop position on the lower side of the needle plate 18 without moving to the upper side of the needle plate 18 since the follower 56 is in contact with the escape driving cam 34. At this time, the needle bar 14 is driven upwardly and downwardly via the needle rod vertically driving mechanism 55 similar to normal operation.

Figure 16:
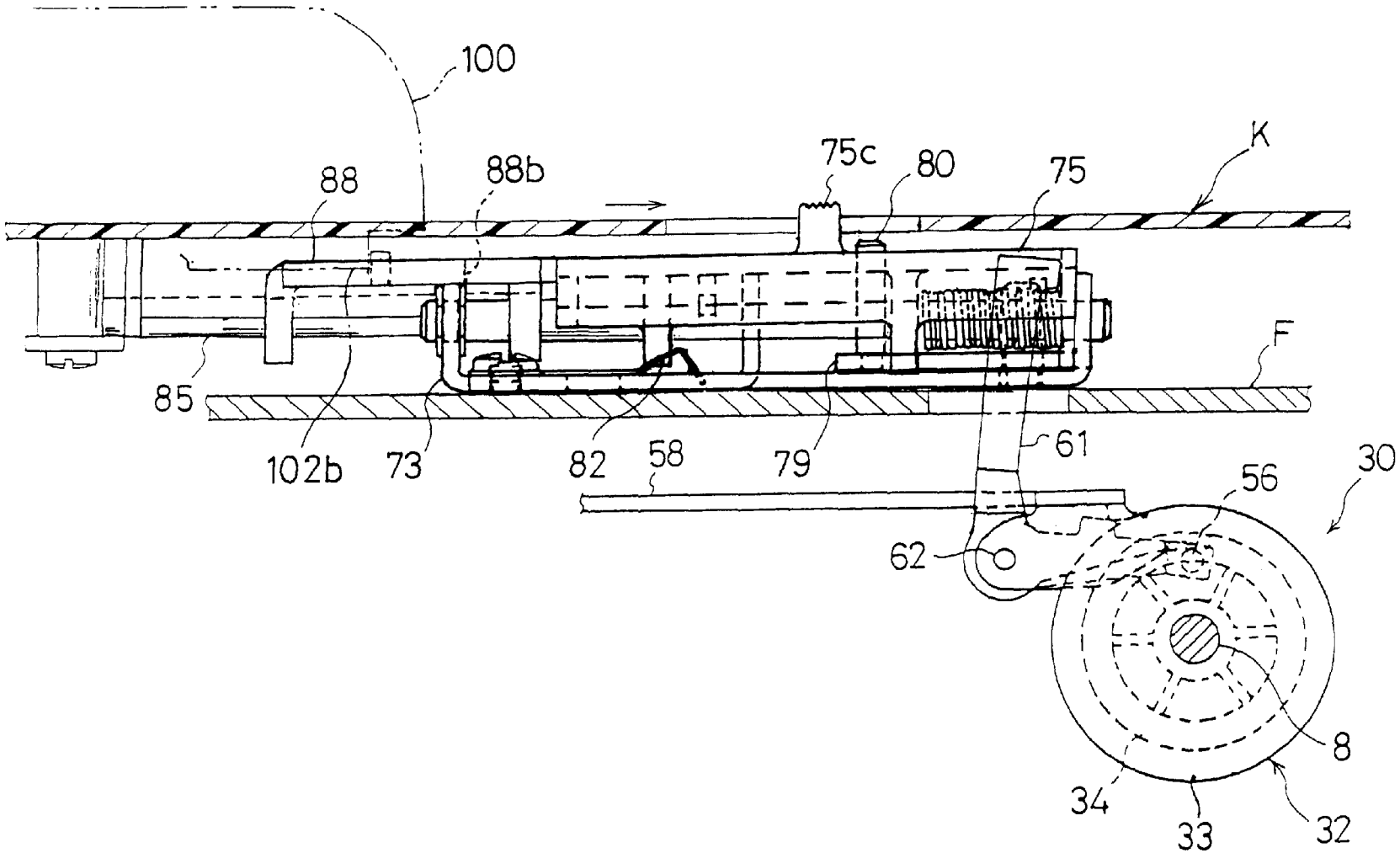
FIG. 16 is a view corresponding to FIG. 11.
Figure 17:
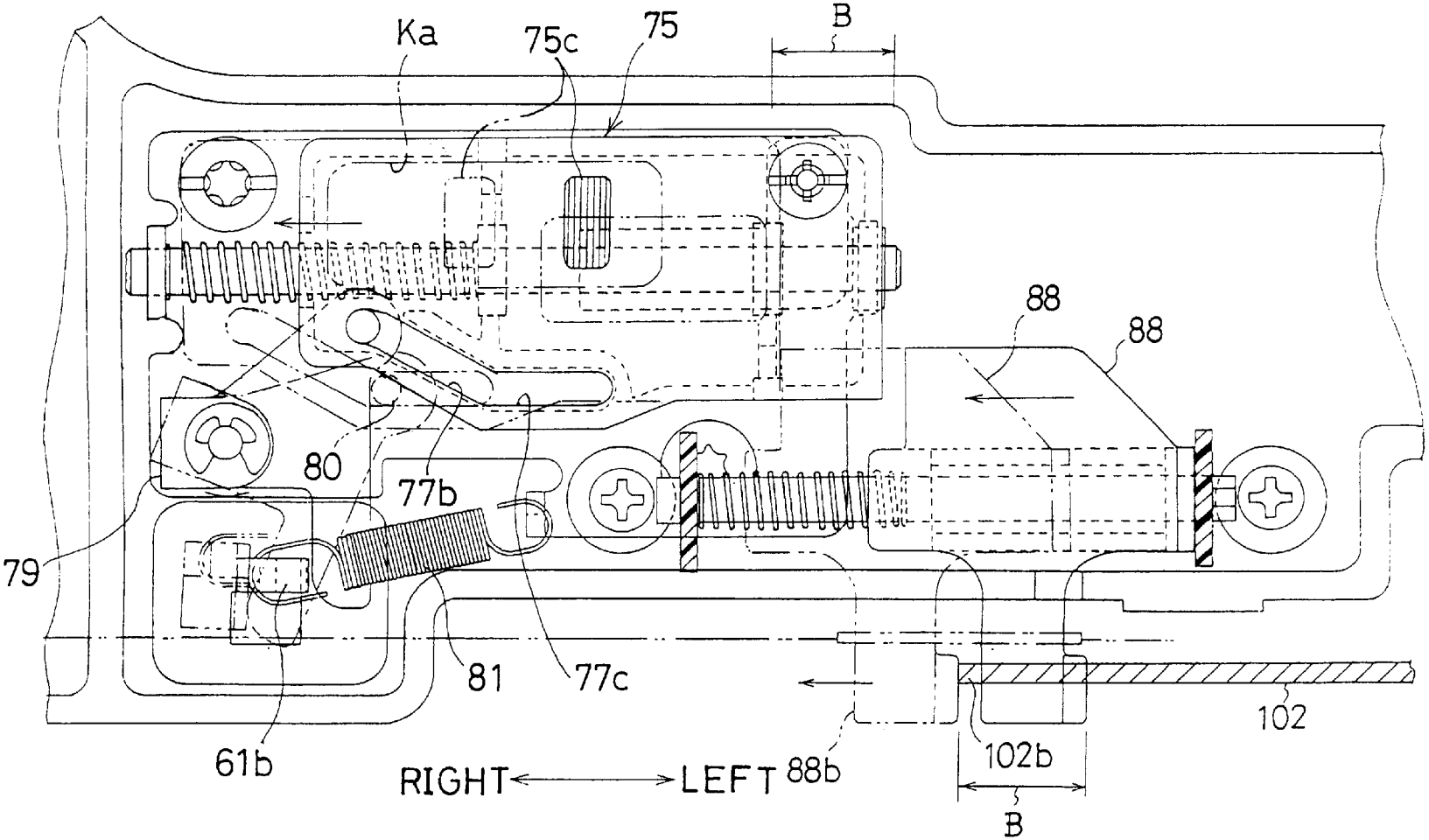
FIG. 17 is a view corresponding to FIG. 12.

Meanwhile, when the cloth feeding unit 100 is mounted to the free arm portion 1*a* of the sewing machine M, as shown by FIGS. 15 through 17, the contact portion 88*b* of the moving member 88 is pressed to move in correspondence with the moving distance B by the pressing portion 102*b* of the horizontal wall portion 102.

At this time, when the cloth feeding unit 100 is firmly mounted to the sewing machine M, switching of the feed dog 40 to the drop position can easily be confirmed by optically observing movement of the contact portion 88*b* to the predetermined pressing position. As a result, as mentioned above, the slide member 75 is moved to the feed dog automatic drop position (chain lines in FIG. 17) in correspondence with the moving distance B, similar to the case of manual operation, the pivoting lever 79 is pivoted to the operating position, the switch lever 61 is switched firmly to the drop position and the follower 56 is switched firmly to the position in correspondence with the escape driving cam 34.

Also in this case, as shown by FIG. 15, switching of the feed dog 40 to the drop position can easily be confirmed by visually observing movement of the operating portion 75*c* to the vicinity of the position of the mark M2 indicating the drop position of the feed dog 40.

Further, when mounting of the cloth feeding unit 100 to the sewing machine M is incomplete, the contact portion 88*b* is not moved to the predetermined pressing position, the slide member 75 is not moved to the feed dog automatic drop position and accordingly, it is known at a glance that the cloth feeding unit 100 is not firmly mounted to the sewing machine M by visually observing the operating portion 75*c* and the drop position mark M2. In this case, the pressing portion 102*b* installed at the cloth feeding unit 110 is a portion of the horizontal wall portion 102 and does not project at all. Accordingly, adhesion of dirt can be prevented.

Although a detailed explanation has been given of the preferred embodiments according to the invention as mentioned above, the invention can naturally be implemented by adding various modifications within a range not deviated from the technical thought of the invention.

For example, only examples of the feed dog horizontally driving mechanism 50, the feed dog vertically driving mechanism 55, the feed dog drop mechanism 70 have been shown but they can be provided using various publicly-known mechanisms.

What is claimed is:

1. A sewing machine having a free lower arm, the sewing machine comprising:

an embroidery cloth feeding unit attachably and detachably mounted to the free lower arm;

a moving member installed at a lower portion of the free lower arm and moved by mounting the embroidery cloth feeding unit; and a vertically moving mechanism driven by movement of the moving member for upwardly and downwardly moving a feed dog of the sewing machine, wherein at least a portion of the moving member is exposed such that the portion can be visually observed from outside of the free lower arm.

2. The sewing machine according to claim 1, wherein the embroidery cloth feeding unit includes a horizontal wall portion slidably brought into contact with a lower portion of the free lower arm and a portion of the horizontal wall portion includes a contact member for moving the moving member when the embroidery cloth feeding unit is mounted to the free lower arm.

3. The sewing machine according to claim 1, wherein the moving member is provided at one of a front end portion and a rear end portion of the free lower arm.

4. The sewing machine according to claim 1, further comprising a switch manually switchable between a first position and a second position, wherein the vertically moving mechanism is moved to an elevated position when the switch is switched to the first position and moved to a lowered position when the switch is switched to the second position and the switch is switched to the second position by being pressed by the movement of the moving member when the embroidery cloth feeding unit is mounted to the free lower arm.

5. A sewing machine having a free lower arm, the sewing machine comprising:

an embroidery cloth feeding unit attachably and detachably mounted to the free lower arm and including a horizontal wall engaged with a lower side of the free lower arm;

a moving member installed at a lower portion of the free lower arm and moved by mounting the embroidery cloth feeding unit; and a horizontally moving mechanism driven by movement of the moving member for upwardly and downwardly moving a feed dog of the sewing machine, wherein the horizontal wall includes a contact portion constituting a portion of the horizontal wall and moving the moving member by being brought into contact therewith when the embroidery cloth feeding unit is mounted to the free lower arm.

6. The sewing machine according to claim 5, wherein the moving member is disposed at a first position when the embroidery cloth feeding unit is not mounted to the free lower arm and is disposed at a second position when the embroidery cloth feeding unit is mounted to the free lower arm and the contact portion is provided with a length equal to an interval between the first position and the second position in a direction of being mounted to the free lower arm.

7. A sewing machine having a free lower arm, said sewing machine comprising:

a manually switch switchable between a first position and a second position;

a vertically moving mechanism for upwardly and downwardly moving a feed dog between an elevated position and a lowered position by switching the switch;

an embroidery cloth feeding unit attachably and detachably mounted to the free lower arm; and a moving member installed at a lower portion of the free arm moved by mounting the embroidery cloth feeding unit, wherein the switch is switched to the second position by being pressed by movement of the moving member when the embroidery cloth feeding unit is mounted to the free lower arm.

8. The sewing machine according to claim 7, wherein the switch includes marks displaying whether the feed dog is disposed at an elevated position or disposed at a lowered position.

9. A sewing machine, having a bed, a free arm extending from the bed, a pedestal extending upwardly from the bed, and a sewing arm extending from an upper end of the pedestal over the free arm in an opposing relationship, comprising:

a feed dog movable in an opening in an upper surface of the free arm;

a first feed dog movement mechanism housed in the bed and an extending free arm that moves the feed dog between an operating position and a recessed position below a surface of the free arm;

a second feed dog movement mechanism housed in the bed and an extending free arm that moves the feed dog in a forward and rearward reciprocating motion;

a switch operatively linked to the first feed dog movement mechanism movable from a first position where the feed dog is in the operating position and a second position where the feed dog is recessed;

a feed cloth moving member that removably mounts to the free arm for embroidery sewing;

a moving member mounted in the bed and having a contact portion extending out of the bed, the moving member shifting the second feed dog movement mechanism from the first position to the second position when the feed cloth moving member is mounted to the free arm, the moving member position observable by an operator.

10. The sewing machine according to claim 9, wherein the switch includes an operating portion extending from an opening in the bed and observable by the operator.

11. The sewing machine according to claim 10, further comprising position marks on the bed, adjacent the opening in the bed indicating at least the first position and the second position.

* * * * *